US008402947B2

(12) United States Patent
Kannan et al.

(10) Patent No.: US 8,402,947 B2
(45) Date of Patent: Mar. 26, 2013

(54) FUEL RAIL FOR ATTENUATING RADIATED NOISE

(75) Inventors: Venkatesh Kannan, Novi, MI (US); Jason Schwanke, Manitowoc, WI (US); Chad D. Ormsbee, Brighton, MI (US); John P. Casari, Manchester, MI (US)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 13/530,308

(22) Filed: Jun. 22, 2012

(65) Prior Publication Data

US 2012/0255522 A1 Oct. 11, 2012

Related U.S. Application Data

(63) Continuation of application No. 12/870,585, filed on Aug. 27, 2010, now Pat. No. 8,251,047.

(51) Int. Cl.
*F02M 69/46* (2006.01)

(52) U.S. Cl. ..... 123/456; 123/467; 123/468

(58) Field of Classification Search ..... 123/456, 123/467, 468, 469, 470; 138/26–31
See application file for complete search history.

(56) References Cited

U.S. PATENT DOCUMENTS

| | | | | |
|---|---|---|---|---|
| 5,373,824 | A * | 12/1994 | Peters et al. | 123/527 |
| 5,575,262 | A | 11/1996 | Rohde | |
| 5,718,206 | A | 2/1998 | Sawada et al. | |
| 5,752,486 | A * | 5/1998 | Nakashima et al. | 123/467 |
| 6,401,691 | B1 | 6/2002 | Kawano et al. | |
| 6,418,909 | B2 | 7/2002 | Rossi et al. | |
| 6,418,910 | B1 | 7/2002 | Nally et al. | |
| 6,463,911 | B1 | 10/2002 | Treusch et al. | |
| 6,615,801 | B1 | 9/2003 | Zdroik | |
| 6,640,783 | B2 | 11/2003 | Braun et al. | |
| 6,725,839 | B2 | 4/2004 | Zdroik et al. | |
| 6,742,504 | B2 | 6/2004 | Seymour, II et al. | |
| 6,761,150 | B2 | 7/2004 | Zdroik | |
| 6,848,477 | B2 | 2/2005 | Treusch et al. | |
| 6,871,637 | B2 | 3/2005 | Tsuchiya et al. | |
| 6,892,704 | B2 | 5/2005 | Tsuchiya et al. | |
| 6,905,002 | B2 | 6/2005 | Bagga et al. | |
| 6,925,989 | B2 | 8/2005 | Treusch et al. | |
| 6,948,585 | B2 | 9/2005 | Lei et al. | |
| 6,978,765 | B2 | 12/2005 | Kilgore | |

(Continued)

FOREIGN PATENT DOCUMENTS

| | | |
|---|---|---|
| EP | 0995902 | 4/2000 |
| EP | 1921304 | 5/2008 |

(Continued)

OTHER PUBLICATIONS

International Search Report and Written Opinion for International Appl. No. PCT/US2011/048718 dated Oct. 7, 2011, 10 pages.

*Primary Examiner* — Thomas Moulis
(74) *Attorney, Agent, or Firm* — Michael Best & Friedrich LLP

(57) ABSTRACT

A fuel rail includes an elongated tube having an inlet and a plurality of outlets. The elongated tube defines a fuel passageway for directing fuel toward the plurality of outlets. The fuel rail also includes a plurality of immovable baffles positioned within the elongated tube to divide the fuel passageway into a plurality of chambers such that each outlet is positioned in one of the plurality of chambers. The plurality of baffles restricts fluid flow between adjacent chambers. A majority of the plurality of outlets are located essentially at an acoustic node of each corresponding chamber to reduce noise generated by the fuel rail.

26 Claims, 10 Drawing Sheets

U.S. PATENT DOCUMENTS

| | | | |
|---|---|---|---|
| 7,146,965 | B1 | 12/2006 | Li et al. |
| 7,341,045 | B2 | 3/2008 | Sims, Jr. et al. |
| 7,520,268 | B1 | 4/2009 | Sims, Jr. |
| 7,681,553 | B2 | 3/2010 | Cora et al. |
| 7,682,117 | B2 | 3/2010 | Holt et al. |
| 7,827,962 | B2 | 11/2010 | Weizenauer et al. |
| 8,037,868 | B2 | 10/2011 | Kannan et al. |
| 8,100,111 | B2 | 1/2012 | Stingele |
| 2002/0043249 | A1 | 4/2002 | Lee et al. |
| 2008/0127941 | A1 | 6/2008 | Iben et al. |
| 2009/0301438 | A1 | 12/2009 | D'Onofrio et al. |

FOREIGN PATENT DOCUMENTS

| | | |
|---|---|---|
| FR | 2895033 | 6/2007 |
| JP | 09170514 | 6/1997 |
| JP | 2001193599 | 7/2001 |
| JP | 2009222064 | 10/2009 |

* cited by examiner

FUEL RAIL FOR ATTENUATING RADIATED NOISE

RELATED APPLICATIONS

This application is a continuation of U.S. patent application Ser. No. 12/870,585 filed Aug. 27, 2010, the entire content of which is hereby incorporated by reference herein.

BACKGROUND

The present invention relates to fuel rails and, more particularly, to fuel rails for attenuating radiated noise.

Fuel rails typically supply fuel to fuel injectors that are in communication with corresponding inlet ports of internal combustion engines. During operation of the engines, the fuel injectors are sequentially energized and actuated to inject fuel from fuel rail cavities into the engines. However, actuating the fuel injectors excites resonant frequencies of the fuel rail cavities. These resonant frequencies are manifested as audible noise and vibration in the fuel rails.

SUMMARY

In one embodiment, the invention provides a fuel rail including an elongated tube having an inlet and a plurality of outlets. The elongated tube defines a fuel passageway for directing fuel toward the plurality of outlets. The fuel rail also includes a plurality of immovable baffles positioned within the elongated tube to divide the fuel passageway into a plurality of chambers such that each outlet is positioned in one of the plurality of chambers. The plurality of baffles restricts fluid flow between adjacent chambers. A majority of the plurality of outlets are located essentially at an acoustic node of each corresponding chamber to reduce noise generated by the fuel rail.

In some embodiments, the majority of the plurality of outlets may be located at the acoustic node of each corresponding chamber to eliminate hydraulic noise generated by a resonant mode of the fuel passageway.

In another embodiment, the invention provides a method of manufacturing a fuel rail. The fuel rail includes an elongated tube having an inlet and a plurality of outlets. The elongated tube defines a fuel passageway for directing fuel toward the plurality of outlets. The method includes providing a plurality of baffles in the elongated tube to divide the fuel passageway into a plurality of chambers. The plurality of baffles restricts fluid flow between adjacent chambers. The method also includes immovably positioning the plurality of baffles such that each outlet is positioned in one of the plurality of chambers and a majority of the plurality of outlets are located essentially at an acoustic node of each corresponding chamber to reduce noise generated by the fuel rail.

In some embodiments, the plurality of baffles may be positioned such that the majority of the plurality of outlets are located at the acoustic node of each corresponding chamber to eliminate hydraulic noise generated by a resonant mode of the fuel passageway.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
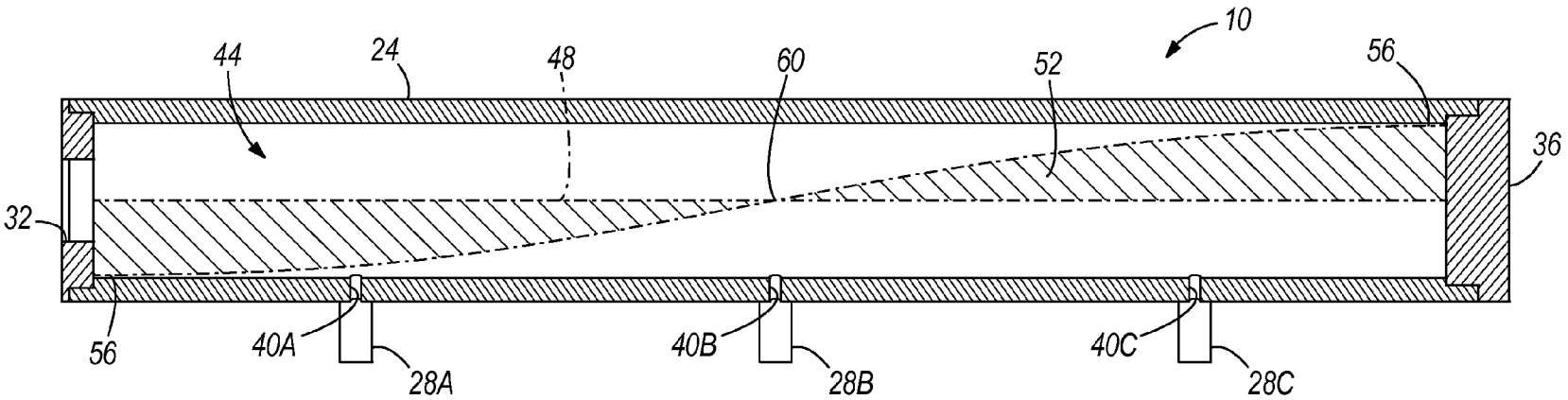
FIG. 1 is a cross-sectional view of a fuel rail.

FIG. 1 illustrates a fuel rail 10 for use in a fuel injection system to supply fuel (e.g., gasoline, diesel fuel, etc.) to a fuel-injected internal combustion engine. The illustrated fuel rail 10 includes an elongated tube 24 and a plurality of fuel injectors 28A, 28B, 28C. In the illustrated embodiment, the elongated tube 24 is coupled to three fuel injectors 28A-C such that the fuel rail 10 is usable with an I3 engine or a V6 engine. In other embodiments, the elongated tube 24 may be coupled to fewer or more fuel injectors such that the fuel rail 10 is usable with different size engines (e.g., I4, I5, V8, V10, etc.).

As shown in FIG. 1, the elongated tube 24 includes an inlet 32 at one end of the tube 24, a blind or closed end 36 opposite the inlet 32, and a plurality of outlets 40A, 40B, 40C. The elongated tube 24 defines a fuel passageway 44 and a longitudinal axis 48 extending between the inlet 32 and the closed end 36. The inlet 32 is connectable to a fuel pump or other fuel source to direct fuel into the fuel passageway 44. The outlets 40A-C are in communication with the fuel passageway 44 to receive fuel from the passageway 44. Each outlet 40A-C is also coupled to and in communication with one of the injectors 28A-C to supply fuel from the fuel passageway 44 to the engine.

During operation of the engine, the fuel passageway 44 of the fuel rail 10 is filled with fuel through the inlet 32. The fuel injectors 28A-C are then actuated to inject fuel from the fuel passageway 44 into the engine, creating acoustic waves within the elongated tube 24. In some embodiments, such as the illustrated embodiment, the fuel rail 10 can be a high-pressure fuel rail such that the injectors 28A-C receive fuel from the fuel passageway 44 at a pressure greater than 20 bar to supply fuel to a gasoline direct injection (GDI) engine. In such embodiments, actuation of the injectors 28A-C creates strong pressure waves having a fundamental cavity resonant frequency greater than 1000 Hz, whose actual value is determined using the equation:

$$f = \frac{c}{2L}$$

where f is the fundamental cavity resonant frequency, c is the speed of sound in pressurized fuel, and L is the length of the fuel passageway 44.

As shown in FIG. 1, the acoustic waves have a fundamental hydraulic mode 52 with an acoustic anti-node 56 at each end of the tube 24 and an acoustic node 60 at a midpoint along the longitudinal axis 48 of the tube 24. As the injectors 28A-C are continually actuated, the injectors 28A, 28C located near the anti-nodes 56 (i.e., adjacent the inlet 32 and the closed end 36 of the tube 24) excite the fundamental mode 52, generating audible noise and vibrations in the fuel rail 10. The middle injector 28B located at and aligned with the node 60 generally does not excite the fundamental mode 52. The middle injector 28B therefore only generates minimal noise or vibrations to the fuel rail 10.

Figure 2:
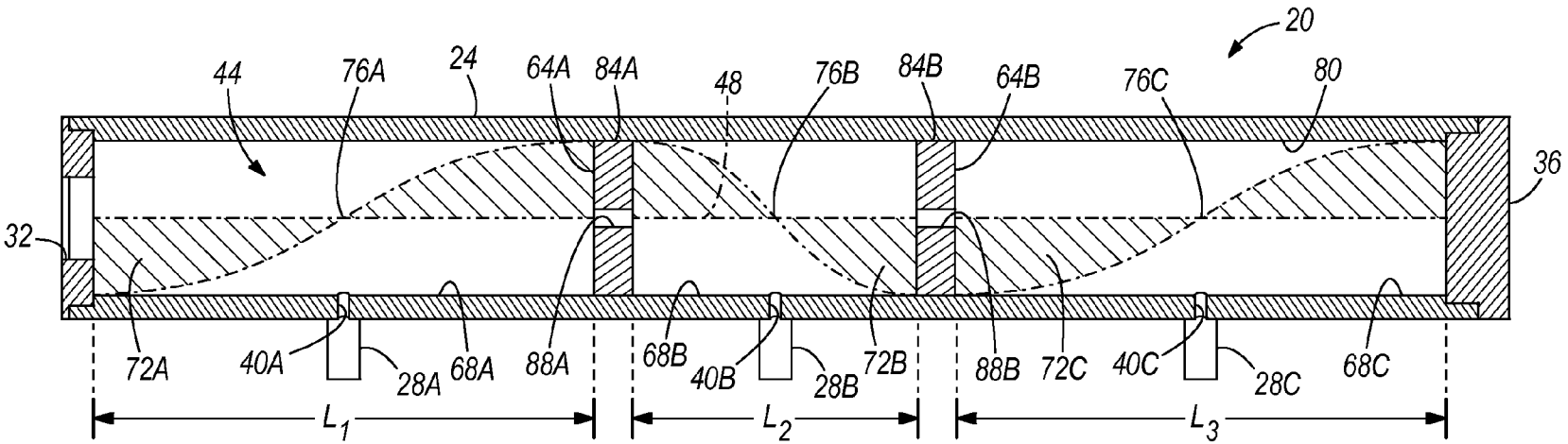
FIG. 2 is a cross-sectional view of the fuel rail shown in FIG. 1 including a plurality of baffles embodying the present invention.

FIG. 2 illustrates a fuel rail 20 including a plurality of baffles 64A, 64B positioned within the elongated tube 24. The baffles 64A-B divide the fuel passageway 44 into a plurality of chambers 68A, 68B, 68C such that each outlet 40A-C is positioned in one of the chambers 68A-C. In the illustrated embodiment, the fuel rail 20 includes two baffles 64A-B to divide the fuel passageway 44 into three chambers 68A-C such that each outlet 40A-C is positioned in a separate chamber 68A-C. In other embodiments, the fuel rail 20 may include fewer or more baffles to acoustically divide the fuel passageway 44 into fewer or more chambers, depending on the number of outlets and fuel injectors. The baffles 64A-B restrict fluid flow to acoustically divide adjacent chambers 68A-C by reducing a cross-sectional area of the fuel passageway 44. For example, the baffles 64A-B may reduce the cross-sectional area of the fuel passageway 44 by about 90% to about 99%. In the illustrated embodiment, the baffles 64A-B reduce the cross-sectional area of the fuel passageway 44 by about 98% to about 99%. The baffles 64A-B acoustically isolate the chambers 68A-C from one another such that each chamber 68A-C has a fundamental mode 72A, 72B, 72C at a frequency nearly three times that of the fundamental cavity resonant frequency of the fuel rail 20. By isolating the chambers 68A-C, pressure waves from one chamber 68A-C are not transmitted in phase to other chambers 68A-C.

As shown in FIG. 2, each chamber 68A-C has a length $L_1$, $L_2$, $L_3$ measured along the longitudinal axis 48 of the elongated tube 24. In some embodiments, the baffles 64A-B may be evenly spaced apart along the longitudinal axis 48 such that each chamber 68A-C has the same length. In the illustrated embodiment, the baffles 64A-B are unequally spaced such that the chambers 68A-C have different lengths $L_1$, $L_2$, $L_3$. The baffles 64A, 64B are positioned within the elongated tube 24 such that an acoustic node 76A, 76B, 76C at the fundamental frequency of each chamber 68A-C is aligned with the corresponding outlet 40A-C. Each acoustic node 76A-C is located approximately at a midpoint of the length $L_1$, $L_2$, $L_3$ of the corresponding chamber 68A-C. The baffles 64A-B are therefore positioned within the elongated tube 24 such that each outlet 40A-C is located approximately at the midpoint of the length $L_1$, $L_2$, $L_3$ of the corresponding chamber 68A-C. In the illustrated embodiment, every outlet 40A-C is located at the acoustic node 76A-C of each corresponding chamber 68A-C. In other embodiments, only a majority (i.e., more than 50%) of the outlets 40A-C may be located at the acoustic node 76A-C of each corresponding chamber 68A-C.

By positioning the baffles 64A-B such that the outlets 40A-C are located exactly at the acoustic node 76A-C of the fundamental mode 72A-C in each chamber 68A-C, audible noise and vibration in the fuel rail 20 at the fundamental mode frequency is completely eliminated. When the baffles 64A-B are positioned such that the outlets 40A-C are slightly offset from the acoustic node 76A-C of each chamber 68A-C, the audible noise and vibration at the fundamental frequency of the respective chamber 68A-C is present, but at a very low amplitude and at a frequency nearly three times higher than the fundamental frequency of the fuel rail 10 (FIG. 1) without the baffles 64A-B. As used herein and in the appended claims, the outlets 40A-C are described as being positioned or located "essentially at" the acoustic nodes 76A-C to encompass both configurations where the outlets 40A-C are positioned exactly at the acoustic nodes 76A-C and configurations where the outlets 40A-C are slightly offset from the acoustic nodes 76A-C (e.g., within $1/8^{th}$ of the length of the respective chamber 68A-C).

When the fuel injectors 28A-C are actuated, acoustic waves are created within the elongated tube 24. Since the outlets 40A-C, and thereby the fuel injectors 28A-C, are located at the acoustic nodes 76A-C in each chamber 68A-C, actuation of the injectors 28A-28C generally does not excite the fundamental modes 72A-C of the acoustic waves. The fuel rail 20 therefore generates less noise and vibration than a similar fuel rail without baffles positioned in the manner described above (e.g., the fuel rail 10 shown in FIG. 1).

Figure 3:
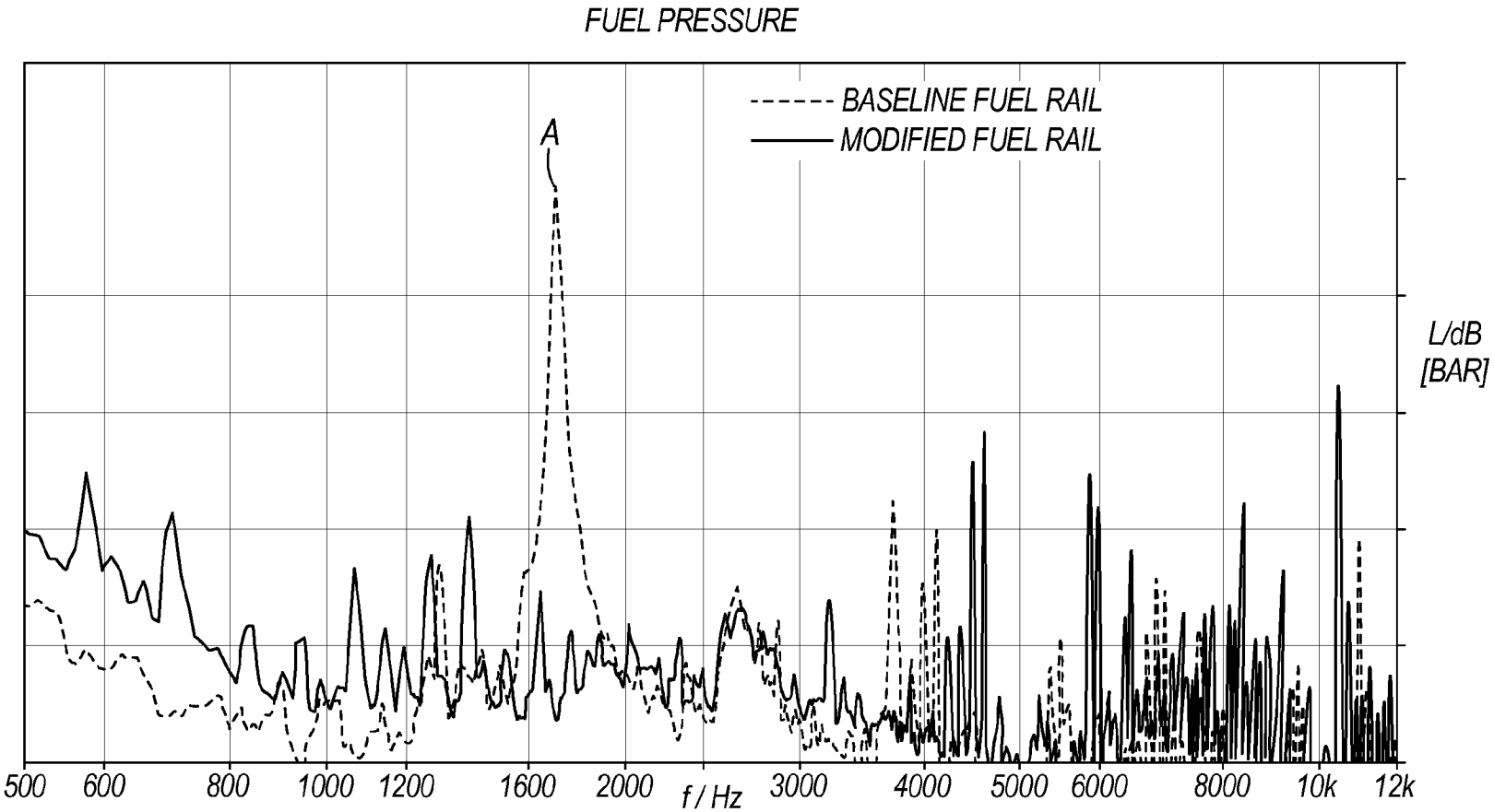
FIG. 3 is a frequency spectrum graph comparing fuel pressure in a baseline fuel rail without baffles and in a modified fuel rail that includes baffles.
Figure 4:
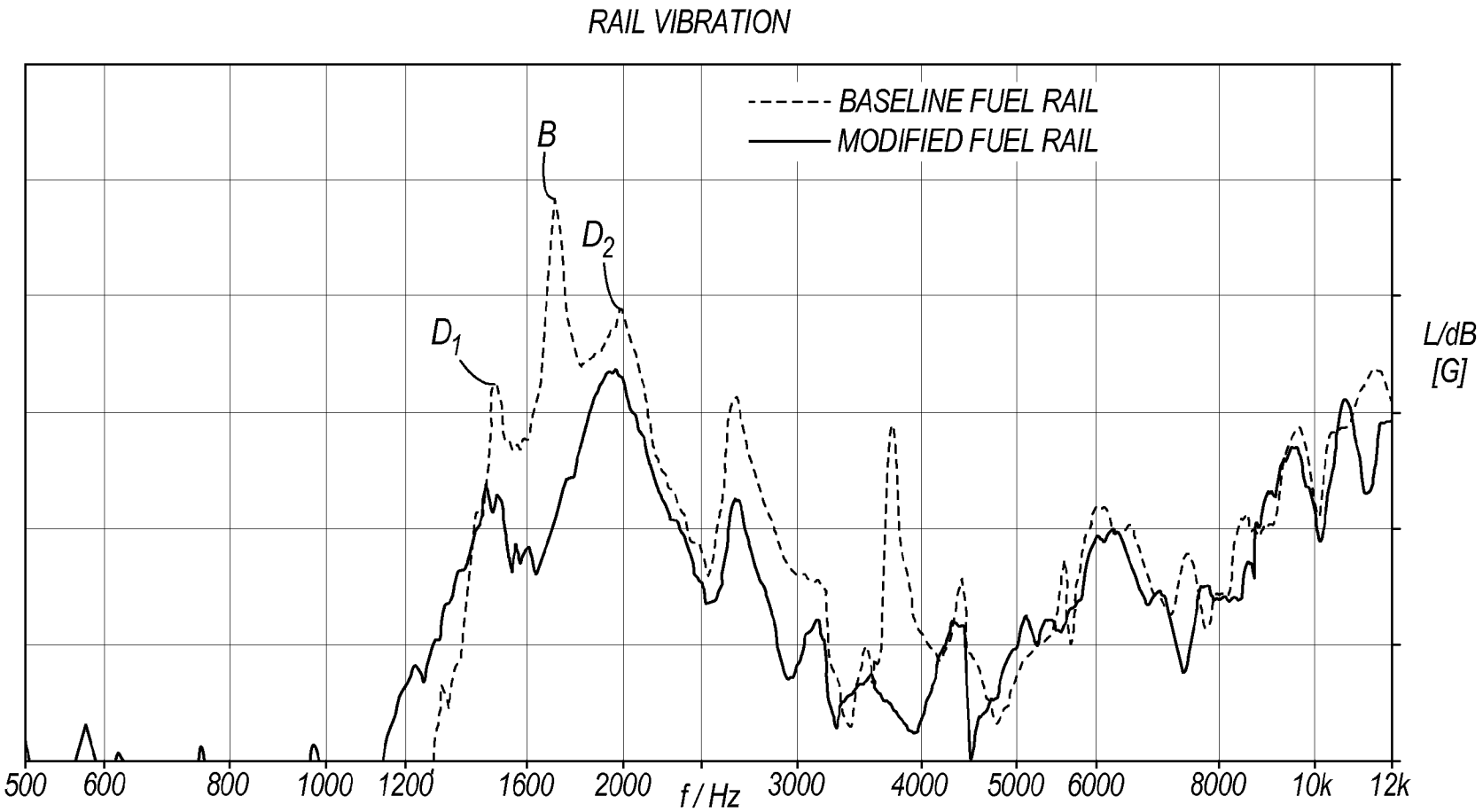
FIG. 4 is a frequency spectrum graph comparing rail vibration in the baseline fuel rail and in the modified fuel rail.
Figure 5:
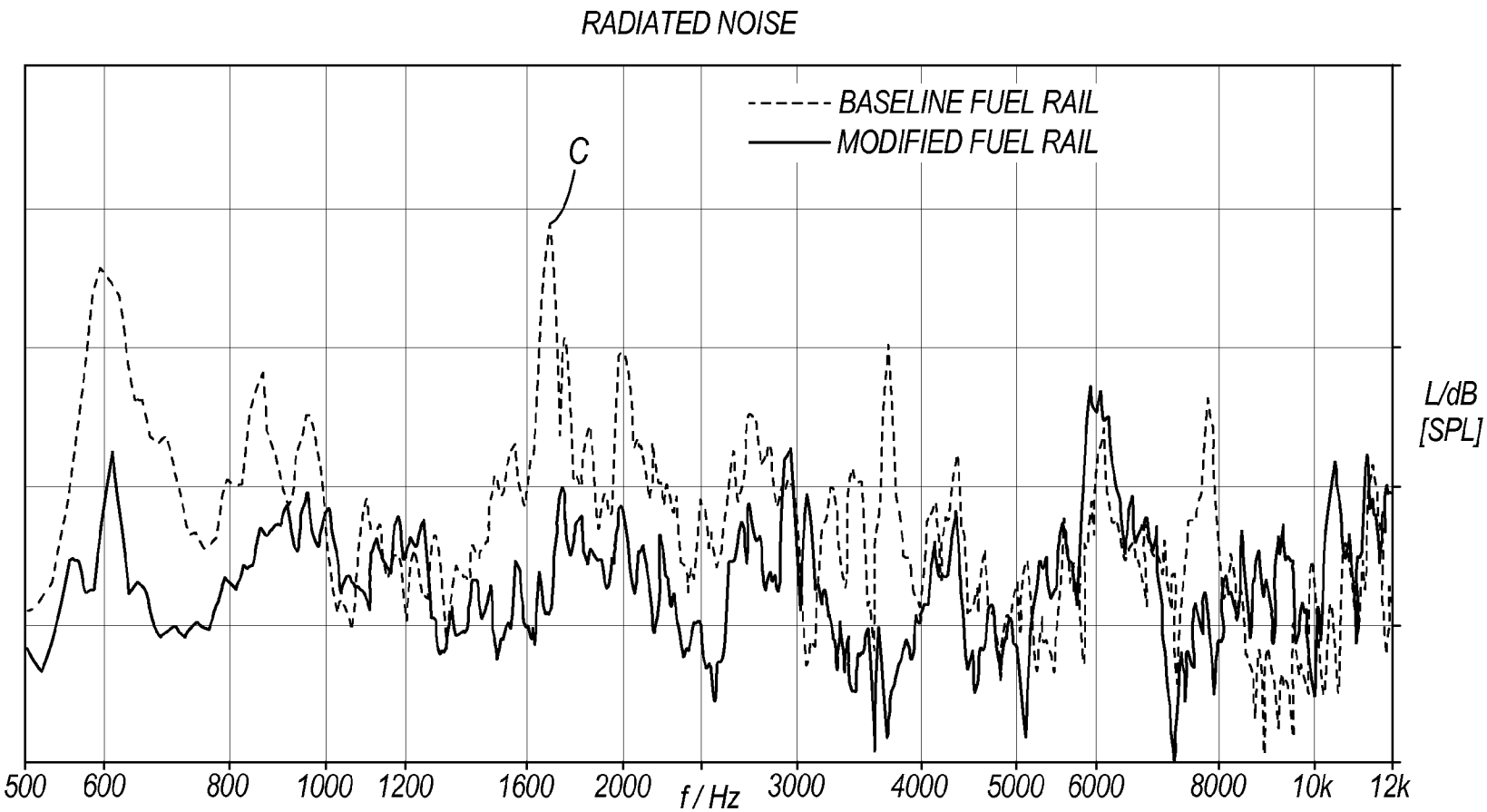
FIG. 5 is a frequency spectrum graph comparing radiated noise in the baseline fuel rail and in the modified fuel rail.

FIGS. 3-5 are graphs comparing fuel pressure, rail vibration, and radiated noise, respectively, between a baseline fuel rail without baffles (e.g., the fuel rail 10 shown in FIG. 1) and a modified fuel rail that includes baffles (e.g., the fuel rail 20 shown in FIG. 2). As shown in the graphs, the baseline fuel rail 10 has a fundamental cavity resonant frequency at about 1700 Hz. Peaks A, B, and C in FIGS. 3-5, respectively, identify the fundamental mode of the fuel passageway 44 in the baseline fuel rail 10. Peaks $D_1$ and $D_2$ in FIG. 4 identify the structural resonant modes of the baseline fuel rail 10. The cavity resonant frequency is generally a function of fuel rail length and may be higher or lower in fuel rails of different lengths. In the modified fuel rail 20, this resonant frequency is eliminated by dividing the fuel passageway 44 into three smaller chambers 68A-C and aligning a majority of the outlets 40A-C, and thereby the fuel injectors 28A-C, with the acoustic nodes 76A-C in the modified fuel rail 20. With such an arrangement, actuation of the fuel injectors 28A-C does not excite the fundamental modes 72A-C to generate such high resonant frequency amplitudes. Audible noise and vibration radiated by the modified fuel rail 20 at this frequency is therefore eliminated or significantly reduced if the baffles 64A-B are slightly offset or misaligned during placement.

Referring back to FIG. 2, in the illustrated embodiment, the baffles 64A-B are inserts coupled to an inner surface 80 of the elongated tube 24. The inserts 64A-B are generally disc-shaped to match the shape and inner diameter of the elongated tube 24. In other embodiments, the inserts 64A-B may be other shapes (e.g., oblong, rectangular, etc.) to match the shape and size of different fuel rails. An outer edge 84A, 84B of each insert 64A-B is brazed to the inner surface 80 of the elongated tube 24 to immovably secure the inserts 64A-B within the tube 24. In other embodiments, the inserts 64A-B may be immovably secured to the elongated tube 24 using other suitable coupling means, such as, for example, press-fittings or C-clips.

Each insert 64A-B defines an orifice 88A, 88B. The orifices 88A-B extend through the inserts 64A-B to allow fluid communication between adjacent chambers 68A-C. The illustrated orifices 88A-B are generally cylindrical holes that extend through centers of the inserts 64A-B. In other embodiments, the orifices 88A-B may be slits or slots formed in the inserts 64A-B, each insert 64A-B may define multiple orifices that allow fluid communication between the chambers 68A-C, and/or the orifices 88A-B may be offset from the centers of the inserts 64A-B.

Figure 6:
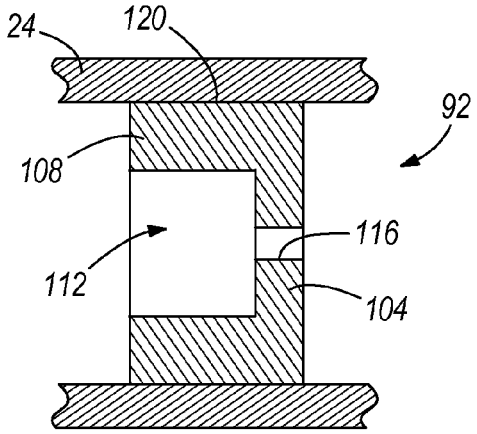
FIG. 6 illustrates a first alternative embodiment of a baffle for use with a fuel rail.
Figure 7:
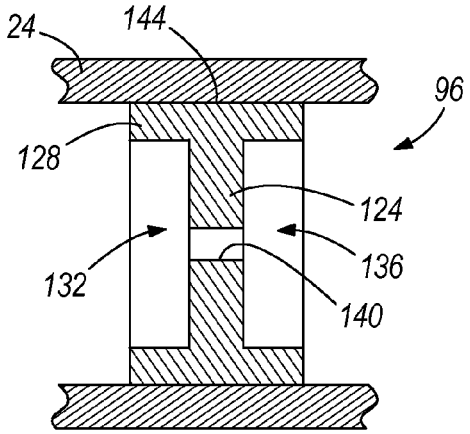
FIG. 7 illustrates a second alternative embodiment of a baffle for use with a fuel rail.
Figure 8:
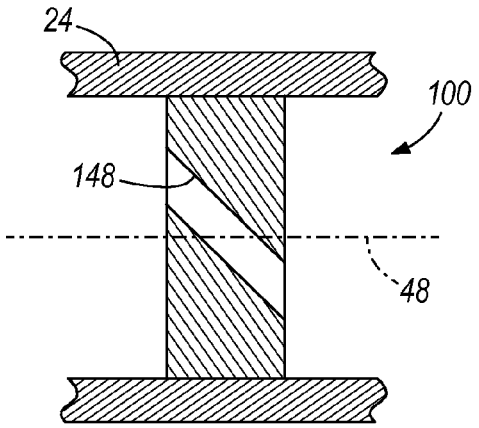
FIG. 8 illustrates a third alternative embodiment of a baffle for use with a fuel rail.

FIGS. 6-8 illustrate alternative embodiments of inserts 92, 96, 100 for use in the fuel rail 20. As shown in FIG. 6, the illustrated insert 92 includes a dividing wall 104 and an extended circumferential portion 108. The dividing wall 104 extends radially inward from an end of the circumferential portion 108 such that the insert 92 defines a cavity 112. The dividing wall 104 and the circumferential portion 108 thereby form a generally C-shaped cross-section. An orifice 116 extends through the dividing wall 104 to allow fluid communication between adjacent chambers of the fuel rail 20. The extended circumferential portion 108 provides a relatively large outer surface 120 for coupling the insert 92 to the elongated tube 24.

As shown in FIG. 7, the illustrated insert 96 includes a relatively thin dividing wall 124 and an extended circumferential portion 128. The dividing wall 124 extends radially inward from a central portion of the circumferential portion 128 such that the insert 96 defines a first cavity 132 and a second cavity 136 on opposing sides of the dividing wall 124. The dividing wall 124 and the circumferential portion 128 thereby form a generally I-shaped cross-section. An orifice 140 extends through the dividing wall 124 to allow fluid communication between adjacent chambers of the fuel rail 20. Similar to the insert 92 shown in FIG. 6, the extended circumferential portion 128 provides a relatively large outer surface 144 for coupling the insert 96 to the elongated tube 24.

As shown in FIG. 8, the illustrated insert 100 has a generally rectangular cross-section, similar to the inserts 64A-B shown in FIG. 2. However, the insert 100 of FIG. 5 defines an orifice 148 that is angled obliquely relative to the longitudinal axis 48 of the elongated tube 24. Angling the orifice 148 relative to the longitudinal axis 48 improves isolation between adjacent chambers while still allowing fluid flow between the chambers. In the illustrated embodiment, the orifice 148 is angled approximately 60° relative to the longitudinal axis 48. In other embodiments, the orifice 148 may be angled by a greater or lesser degree (e.g., between 1° and 89°) relative to the longitudinal axis 48.

Figure 9:
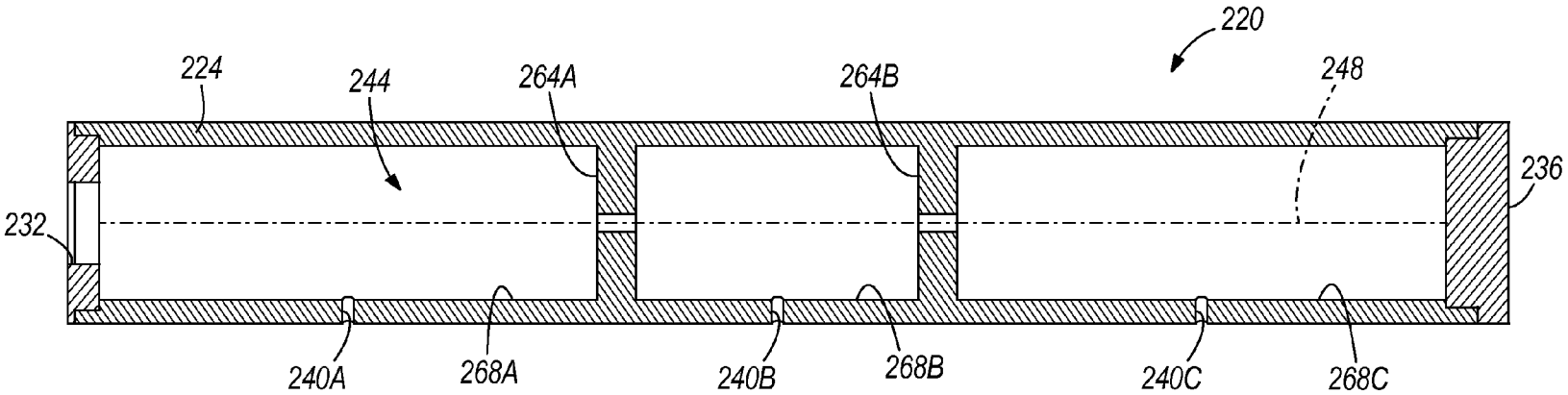
FIG. 9 is a cross-sectional view of another embodiment of a fuel rail including a plurality of baffles.

FIG. 9 illustrates another embodiment of a fuel rail 220. The illustrated fuel rail 220 is similar to the fuel rail 20 shown in FIG. 2, and like parts have been given the same reference numbers plus 200. Reference is hereby made to the fuel rail 20 of FIG. 2 for discussion of features and elements of the fuel rail 220, as well as alternatives to the features and elements, not specifically discussed below.

The illustrated fuel rail 220 includes an elongated tube 224 having an inlet 232 at one end of the tube 224, a blind or closed end 236 opposite the inlet 232, and a plurality of outlets 240A, 240B, 240C. The elongated tube 224 defines a fuel passageway 244 and a longitudinal axis 248 extending between the inlet 232 and the closed end 236. Each outlet 240A-C is connectable to a fuel injector to supply fuel from the fuel passageway 244 to an engine.

The fuel rail 220 also includes a plurality of baffles 264A, 264B positioned within the elongated tube 224. The baffles 264A-B divide the fuel passageway 244 into a plurality of chambers 268A, 268B, 268C such that each outlet 240A-C is positioned in one of the chambers 268A-C. In the illustrated embodiment, the baffles 264A-B are integrally formed as a single piece with the elongated tube 224 and extend radially inward toward the longitudinal axis 248. The baffles 264A-B restrict fluid flow to acoustically divide adjacent chambers 268A-C by reducing a cross-sectional volume of the fuel passageway 244. Similar to the baffles 64A-B shown in FIG. 2, the illustrated baffles 264A-B are positioned and formed within the fuel passageway 244 such that every outlet 240A-C is located at an acoustic node of a fundamental mode in each corresponding chamber 268A-C to reduce noise and vibration generated by the fuel rail 220.

Figure 10:
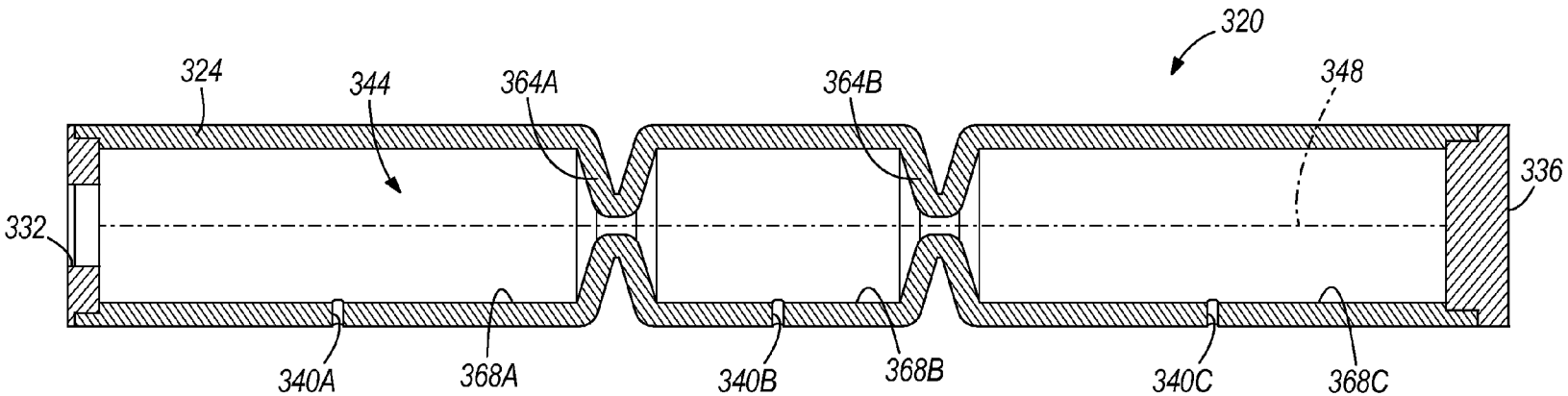
FIG. 10 is a cross-sectional view of yet another embodiment of a fuel rail including a plurality of baffles.

FIG. 10 illustrates another embodiment of a fuel rail 320. The illustrated fuel rail 320 is similar to the fuel rail 20 shown in FIG. 2, and like parts have been given the same reference numbers plus 300. Reference is hereby made to the fuel rail 20 of FIG. 2 for discussion of features and elements of the fuel rail 320, as well as alternatives to the features and elements, not specifically discussed below.

The illustrated fuel rail 320 includes an elongated tube 324 having an inlet 332 at one end of the tube 324, a blind or closed end 336 opposite the inlet 332, and a plurality of outlets 340A, 340B, 340C. The elongated tube 324 defines a fuel passageway 344 and a longitudinal axis 348 extending between the inlet 332 and the closed end 336. Each outlet 340A-C is connectable to a fuel injector to supply fuel from the fuel passageway 344 to an engine.

The fuel rail 320 also includes a plurality of baffles 364A, 364B positioned within the elongated tube 324. The baffles 364A-B divide the fuel passageway 344 into a plurality of chambers 368A, 368B, 368C such that each outlet 340A-C is positioned in one of the chambers 368A-C. In the illustrated embodiment, the baffles 364A-B are integrally formed as a single piece with the elongated tube 324 by reducing a diameter of the elongated tube 324. For example, the baffles 364A-B may be immovably formed by crimping, molding, or otherwise machining or forming relatively smaller diameter portions in the elongated tube 324. The baffles 364A-B restrict fluid flow to acoustically divide adjacent chambers 368A-C by reducing a cross-sectional volume of the fuel passageway 344. Similar to the baffles 64A-B shown in FIG. 2, the illustrated baffles 364A-B are positioned and formed within the fuel passageway 344 such that every outlet 340A-C is located at an acoustic node of a fundamental mode in each corresponding chamber 368A-C to reduce noise and vibration generated by the fuel rail 320.

Figure 11:
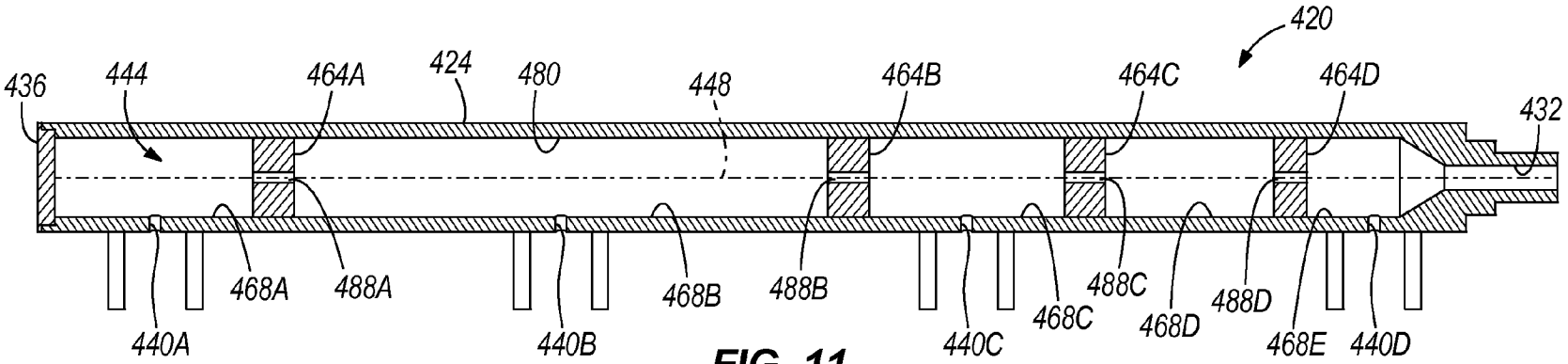
FIG. 11 is a cross-sectional view of still another embodiment of a fuel rail including a plurality of baffles.

FIG. 11 illustrates another embodiment of a fuel rail 420. The illustrated fuel rail 420 is similar to the fuel rail 20 shown in FIG. 2, and like parts have been given the same reference numbers plus 400. Reference is hereby made to the fuel rail 20 of FIG. 2 for discussion of features and elements of the fuel rail 420, as well as alternatives to the features and elements, not specifically discussed below.

As shown in FIG. 11, the fuel rail 420 includes an elongated tube 424 having an inlet 432 at one end of the tube 424, a blind or closed end 436 opposite the inlet 432, and a plurality of outlets 440A, 440B, 440C, 440D. The elongated tube 424 defines a fuel passageway 444 and a longitudinal axis 448 extending between the inlet 432 and the closed end 436. In the illustrated embodiment, the elongated tube 424 includes four outlets 440A-D that are connectable to four fuel injectors to supply fuel from the fuel passageway 444 to an I4 engine or a V8 engine.

The illustrated fuel rail 420 also includes a plurality of baffles 464A, 464B, 464C, 464D positioned within the elongated tube 424. The baffles 464A-D divide the fuel passageway 444 into a plurality of chambers 468A, 468B, 468C, 468D, 468E such that each outlet 440A-D is positioned in one of the chambers 468A, 468B, 468C, 468E. In the illustrated embodiment, the fuel rail 420 includes four baffles 464A-D to divide the fuel passageway 444 into five chambers 468A-E. The baffles 464A-D restrict fluid communication between adjacent chambers 468A-E by dividing the volume of the fuel passageway 444. The illustrated baffles 464A-D are positioned within the elongated tube 424 such that every outlet 440A-D is located at an acoustic node of a fundamental mode in each corresponding chamber 468A, 468B, 468C, 468E to eliminate noise and vibration generated by the fuel rail 420 at a fundamental resonant mode without these baffles.

Since the inlet 432 is an open end of the elongated tube 424, the acoustic node in the chamber 468E closest to the inlet 432 may not necessarily be at a midpoint of the chamber 468E. The acoustic node of the fundamental mode may thereby be found by including the length of the fluid line connected to the inlet 432. Alternatively, the acoustic node may be found through trial-and-error by adjusting the position of the baffle 464D relative to the inlet 432 until resonant frequencies within the chamber 468E are sufficiently reduced. In some embodiments, the need to align the outlet 440D at an acoustic node can be ignored if the noise generated by the injector at the outlet 440D is minimal. For example, the baffle 464D may be omitted even though the outlet 440D closest to the inlet 432 will not be located at an acoustic node. In such embodiments, three of the four outlets 440A, 440B, 440C (i.e., the majority of outlets) are still located at acoustic nodes to significantly reduce the majority of hydraulic noise and vibration generated by the fuel rail 420.

In the illustrated embodiment, the baffles 464A-D are inserts coupled to an inner surface 480 of the elongated tube 424. Similar to the inserts 64A-B discussed above with reference to FIG. 2, the illustrated inserts 464A-D are brazed to the inner surface 480 of the elongated tube 424 to immovably secure the inserts 464A-D within the tube 424. In other embodiments, the inserts 464A-D may be immovably secured to the elongated tube 424 using other suitable coupling means or may be integrally formed as a single piece with the elongated tube 424. Each insert 464A-D defines an orifice 488A, 488B, 488C, 488D. The orifices 488A-D extend through the inserts 464A-D to allow fluid communication between adjacent chambers 468A-E. The illustrated orifices 488A-D are generally cylindrical holes that extend through centers of the inserts 464A-D. In some embodiments, the orifices 488A-D may be angled obliquely relative to the longitudinal axis 448 of the elongated tube 424.

Figure 12:
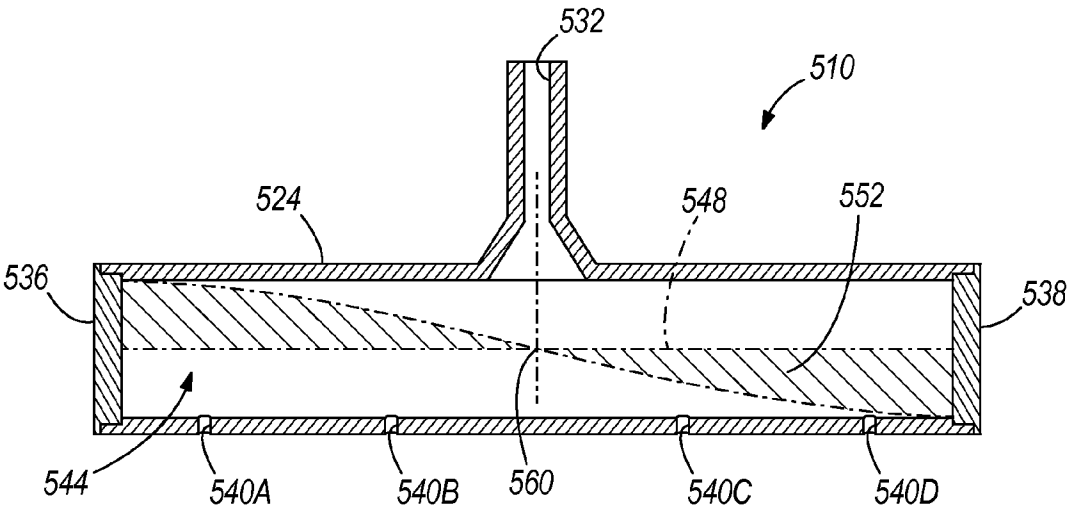
FIG. 12 is a cross-sectional view of another fuel rail.
Figure 13:
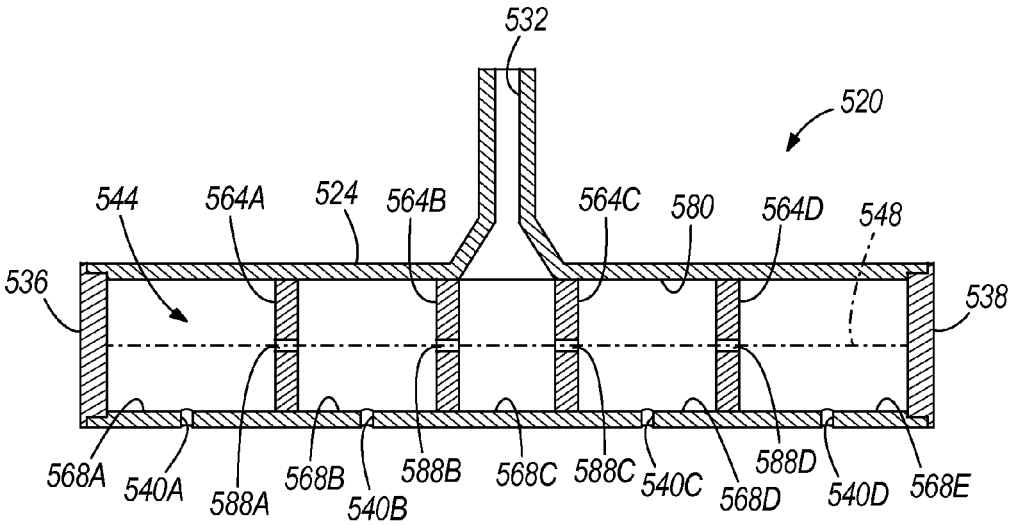
FIG. 13 is a cross-sectional view of the fuel rail shown in FIG. 12 including a plurality of baffles embodying the present invention.

FIGS. 12 and 13 illustrate another embodiment of a fuel rail 510, 520. The illustrated fuel rail 510, 520 is similar to the fuel rail 20 shown in FIG. 2, and like parts have been given the same reference numbers plus 500. Reference is hereby made to the fuel rail 20 of FIG. 2 for discussion of features and elements of the fuel rail 510, 520, as well as alternatives to the features and elements, not specifically discussed below.

As shown in FIG. 12, the fuel rail 510 includes an elongated tube 524 having an inlet 532, a first blind or closed end 536, a second blind or closed end 538, and a plurality of outlets 540A, 540B, 540C, 540D. The elongated tube 524 defines a fuel passageway 544 and a longitudinal axis 548 extending between the closed ends 536, 538. The illustrated inlet 532 is positioned exactly halfway along the longitudinal axis 548 between the first and second closed ends 536, 538 such that pressure pulsations from the inlet 532 caused by a high pressure pump or other hydraulic device enter the fuel rail 520 at an acoustic node 560 of a fundamental hydraulic mode 552 of the fuel passageway 544 and do not excite the node 560. In other embodiments, the inlet 532 may be slightly offset from halfway along the longitudinal axis 548. In the illustrated embodiment, the elongated tube 524 includes four outlets 540A-D that are connectable to four fuel injectors to supply fuel from the fuel passageway 544 to an I4 engine or a V8 engine.

As shown in FIG. 13, the fuel rail 520 includes a plurality of baffles 564A, 564B, 564C, 564D positioned within the elongated tube 524. The baffles 564A-D divide the fuel passageway 544 into a plurality of chambers 568A, 568B, 568C, 568D, 568E such that each outlet 540A-D is positioned in one of the chambers 568A, 568B, 568D, 568E. In the illustrated embodiment, the fuel rail 520 includes four baffles 564A-D to divide the fuel passageway 544 into five chambers 568A-E. With such an arrangement, an outlet is not positioned in the chamber 568C adjacent the inlet 532. The baffles 564A-D restrict fluid flow to acoustically divide adjacent chambers 568A-E by reducing a cross-sectional volume of the fuel passageway 544. The illustrated baffles 564A-D are positioned within the elongated tube 524 such that every outlet 540A-D and the inlet 532 are located at the acoustic node of a fundamental mode in each corresponding chamber 568A-E to eliminate noise and vibration generated by the fundamental mode 552 (FIG. 12). In other embodiments, only a majority of the outlets 540A-D may be located at the acoustic nodes in the chambers 568A, 568B, 568D, 568E to reduce a majority of the noise and vibration generated by the fuel rail 520.

In the illustrated embodiment, the baffles 564A-D are inserts coupled to an inner surface 580 of the elongated tube 524. Similar to the inserts 64A-B discussed above with reference to FIG. 2, the illustrated inserts 564A-D are brazed to the inner surface 580 of the elongated tube 524 to immovably secure the inserts 564A-D within the tube 524. In other embodiments, the inserts 564A-D may be immovably secured to the elongated tube 524 using other suitable coupling means or may be integrally formed as a single piece with the elongated tube 524. Each insert 564A-D defines an orifice 588A, 588B, 588C, 588D. The orifices 588A-D extend through the inserts 564A-D to allow fluid communication between adjacent chambers 568A-E. The illustrated orifices 588A-D are generally cylindrical holes that extend through centers of the inserts 564A-D. In some embodiments, the orifices 588A-D may be angled obliquely relative to the longitudinal axis 548 of the elongated tube 524.

Figure 14:
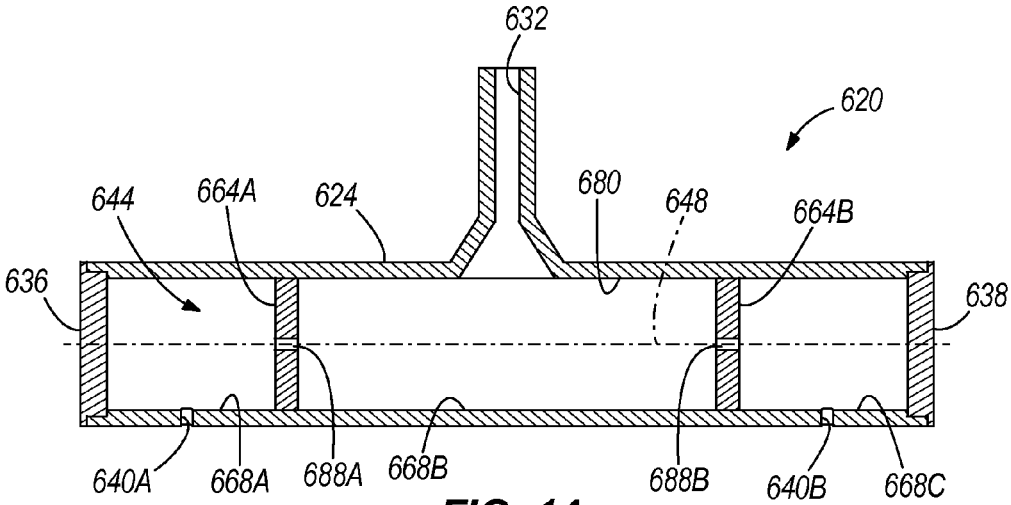
FIG. 14 is a cross-sectional view of yet another embodiment of a fuel rail including a plurality of baffles.

FIG. 14 illustrates another embodiment of a fuel rail 620. The illustrated fuel rail 620 is similar to the fuel rail 20 shown in FIG. 2, and like parts have been given the same reference numbers plus 600. Reference is hereby made to the fuel rail 20 of FIG. 2 for discussion of features and elements of the fuel rail 620, as well as alternatives to the features and elements, not specifically discussed herein.

As shown in FIG. 14, the fuel rail 620 includes an elongated tube 624 having an inlet 632, a first blind or closed end 636, a second blind or closed end 638, and a plurality of outlets 640A, 640B. The elongated tube 624 defines a fuel passageway 644 and a longitudinal axis 648 extending between the closed ends 636, 638. The illustrated inlet 632 is positioned exactly halfway along the longitudinal axis 648 between the first and second closed ends 636, 638 such that pressure pulsations from the inlet 632 enter the fuel rail 620 at the acoustic node of the fundamental hydraulic mode of the fuel passageway 644. In other embodiments, the inlet 632 may be slightly offset from halfway along the longitudinal axis 648. In the illustrated embodiment, the elongated tube 624 includes two outlets 620A-B that are connectable to two fuel injectors to supply fuel from the fuel passageway 644 to an I2 (flat-twin) or a V4 engine.

The illustrated fuel rail 620 also includes a plurality of baffles 664A, 664B positioned within the elongated tube 624. The baffles 664A-B divide the fuel passageway 644 into a plurality of chambers 668A, 668B, 668C such that each outlet 640A-B is positioned in one of the chambers 668A, 668C. In the illustrated embodiment, the fuel rail 620 includes two baffles 664A-B to divide the fuel passageway 644 into three chambers 668A-C. With such an arrangement, an outlet is not positioned in the chamber 668B adjacent the inlet 632. The baffles 664A-B restrict fluid flow to acoustically divide adjacent chambers 668A-C by reducing a cross-sectional volume of the fuel passageway 644. The illustrated baffles 664A-B are positioned within the elongated tube 624 such that every outlet 640A-B and the inlet 632 are located at the acoustic node of a fundamental mode in each corresponding chamber 668A-C to eliminate noise and vibration generated by the fundamental mode.

In the illustrated embodiment, the baffles 664A-B are inserts coupled to an inner surface 680 of the elongated tube 624. Similar to the inserts 64A-B discussed above with reference to FIG. 2, the illustrated inserts 664A-B are brazed to the inner surface 680 of the elongated tube 624 to immovably secure the inserts 664A-B within the tube 624. In other embodiments, the inserts 664A-B may be immovably secured to the elongated tube 624 using other suitable coupling means or may be integrally formed as a single piece with the elongated tube 624. Each insert 664A-B defines an orifice 688A-B. The orifices 688A-B extend through the inserts 664A-B to allow fluid communication between adjacent chambers 668A-C. The illustrated orifices 688A-B are generally cylindrical holes that extend through centers of the inserts 664A-B. In some embodiments, the orifices may be angled obliquely relative to the longitudinal axis 648 of the elongated tube 624.

By positioning baffles within a fuel rail so outlets of the fuel rail are located at acoustic nodes of fundamental modes, resonant frequencies greater than 1000 Hz within the fuel rail can be reduced or eliminated. As discussed above, positioning a majority of the outlets at acoustic nodes significantly reduces noise and vibration generated by the fuel rail. The baffles are generally used in high-pressure fuel rails (e.g., fuel rails with normal operating pressures greater than about 20 bar). Such fuel rails do not include damper or compliance elements positioned within fuel passageways of the rails to dampen pressure pulsations.

Figure 15:
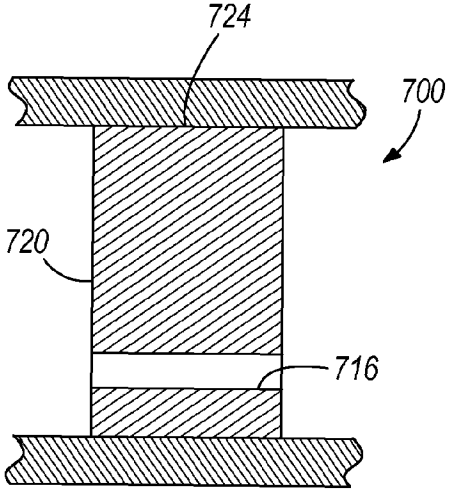
FIGS. 15 and 16 illustrate a fourth alternative embodiment of a baffle for use with a fuel rail.
Figure 16:
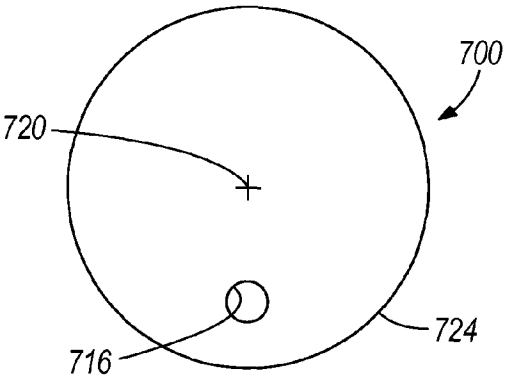

FIGS. 15-19 illustrate alternative embodiments of inserts 700, 704, 708, 712 for use in a fuel rail (e.g., the fuel rails 20, 420, 520, 620 shown in FIGS. 2, 11, 13, and 14). As shown in FIGS. 15 and 16, the insert 700 defines an orifice 716 that extends through the insert 700 to allow fluid communication between adjacent chambers of a fuel rail. The illustrated orifice 716 is offset from a center 720 of the insert 700 such that the orifice 716 is positioned adjacent a periphery 724 of the insert 700 and near the bottom of the fuel rail when the fuel rail is properly oriented relative to an engine. Offsetting the orifice 716 from the center 720 of the insert 700 facilitates fluid flow between the chambers of the fuel rail, especially during a green-fill or first-fill when the rail is connected to the engine and first filled with fuel. During the initial filling of the fuel rail, low pressure fuel can flow quickly through the orifice 716 from one chamber to another before the fuel injectors begin to operate.

Figure 17:
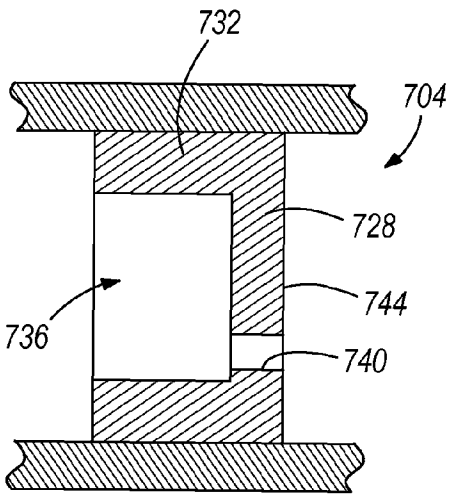
FIG. 17 illustrates a fifth alternative embodiment of a baffle for use with a fuel rail.

As shown in FIG. 17, the illustrated insert 704 includes a dividing wall 728 and an extended circumferential portion 732. The dividing wall 728 extends radially inward from an end of the circumferential portion 732 such that the insert 704 defines a cavity 736. An orifice 740 extends through the dividing wall 728 to allow fluid communication between adjacent chambers of a fuel rail. Similar to the orifice 716 shown in FIGS. 15 and 16, the illustrated orifice 740 is offset from a center 744 of the insert 704.

Figure 18:
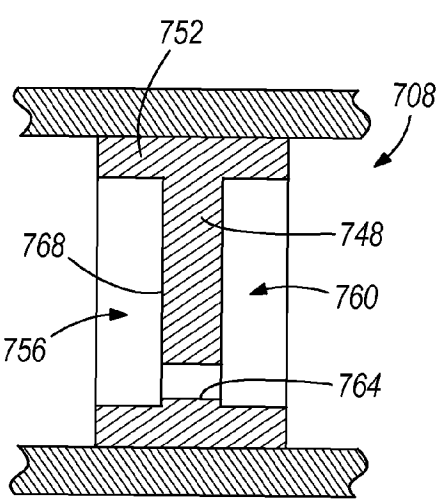
FIG. 18 illustrates a sixth alternative embodiment of a baffle for use with a fuel rail.

As shown in FIG. 18, the illustrated insert 708 includes a dividing wall 748 and an extended circumferential portion 752. The dividing wall 748 extends radially inward from a central portion of the circumferential portion 752 such that the insert 708 defines a first cavity 756 and a second cavity 760 on opposing sides of the dividing wall 748. An orifice 764 extends through the dividing wall 748 to allow fluid communication between adjacent chambers of a fuel rail. Similar to the orifice 716 shown in FIGS. 15 and 16, the illustrated orifice 764 is offset from a center 768 of the insert 708.

Figure 19:
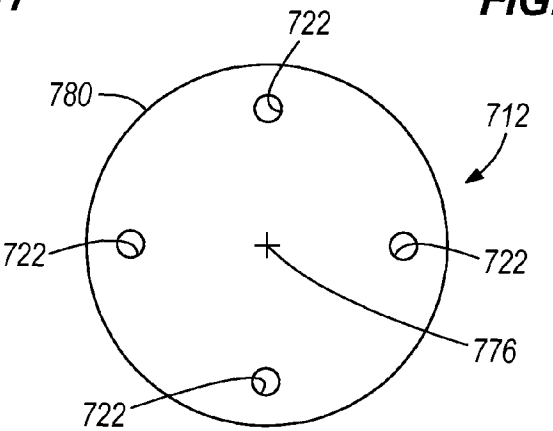
FIG. 19 illustrates a seventh alternative embodiment of a baffle for use with a fuel rail.

As shown in FIG. 19, the illustrated insert 712 defines a plurality of orifices 772 offset from a center 776 of the insert 712 and located adjacent a periphery 780 of the insert 712. The orifices 772 are circumferentially spaced about the periphery 780 of the insert 712 to facilitate positioning the insert 712 within a fuel rail. With such an arrangement, at least one of the orifices 772 will be located at or near the bottom of the fuel rail to facilitate first-fill during assembly of the fuel rail with an engine, regardless of the orientation of the insert 712 relative to the fuel rail. In the illustrated embodiment, the insert 712 defines four orifices 772. In other embodiments, the insert 712 may define fewer or more orifices 772. In still other embodiments, the orifices 772 may be located in other positions relative to each other (e.g., one orifice may extend through the center 776 of the insert 712 and one or more orifices may be located adjacent the periphery 780 of the insert 712).

The illustrated orifices 772 are relatively small-diameter orifices in that each orifice 772 has a smaller diameter than, for example, the single orifice 716 shown in FIG. 16. Taken in aggregate, the orifices 772 have a cross-sectional area or volume that is approximately equal to or larger than the cross-sectional area or volume of the single orifice 716.

Figure 21:
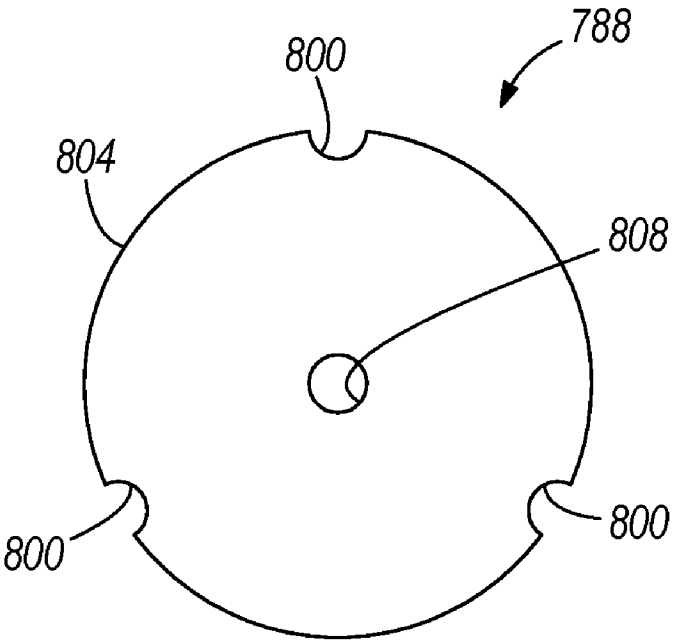
FIG. 21 illustrates a ninth alternative embodiment of a baffle for use with a fuel rail.
Figure 20:
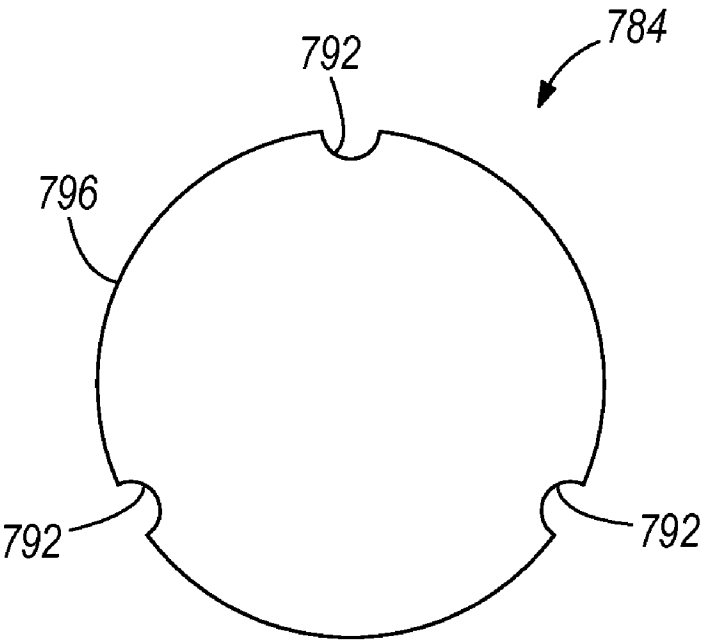
FIG. 20 illustrates an eight alternative embodiment of a baffle for use with a fuel rail.

FIGS. 20 and 21 illustrate additional alternative embodiments of inserts 784, 788 for use in a fuel rail (e.g., the fuel rails 20, 420, 520, 620 shown in FIGS. 2, 11, 13, and 14). As shown in FIG. 20, the insert 784 defines a plurality of orifices 792 located at a periphery 796 of the insert 784 such that the insert 784 is a scalloped disk. In the illustrated embodiment, the insert 784 defines three orifices 792 that are evenly spaced about the periphery 796. In other embodiments, the insert 784 may define fewer or more orifices 792 and/or the orifices 792 may be unevenly spaced. The illustrated insert 784 allows fuel to flow around the periphery 796 of the insert 784 rather than through the insert 784 to flow between adjacent chambers of a fuel rail.

As shown in FIG. 21, the insert 788 defines a plurality of orifices 800 located at a periphery 804 of the insert 788 and an orifice 808 located at a center of the insert 788. Similar to the orifices 792 shown in FIG. 20, the illustrated orifices 800 are evenly spaced about the periphery 804 such that the insert 788 is a scalloped disk. Providing the orifices 800, 808 at both the periphery 804 and the center of the insert 788 increases fluid flow between adjacent chambers of a fuel rail, while still maintaining acoustic isolation between the chambers and facilitating first-fill of the fuel rail during manufacture.

Although the invention has been discussed with specific reference to fuel rails, baffles may also be positioned within a variety of other environments to help reduce noise and vibrations. For example, baffles may be positioned in water mains, oil pipelines, natural gas lines, or other high-pressure conduits to locate a majority of inlets and outlets at acoustic nodes of the conduits.

Various features and advantages of the invention are set forth in the following claims.

What is claimed is:

1. A fuel rail comprising:

an elongated tube including an inlet and a plurality of outlets, the elongated tube defining a fuel passageway for directing fuel toward the plurality of outlets; and a plurality of immovable baffles positioned within the elongated tube to divide the fuel passageway into a plurality of chambers such that each outlet is positioned in one of the plurality of chambers, the plurality of baffles restricting fluid flow between adjacent chambers, wherein a majority of the plurality of outlets are located essentially at an acoustic node of each corresponding chamber to reduce noise generated by the fuel rail.

2. The fuel rail of claim 1, wherein the majority of the plurality of outlets are located at the acoustic node of each corresponding chamber to reduce hydraulic noise generated by a resonant mode of the fuel passageway.

3. The fuel rail of claim 1, wherein each outlet is positioned in a separate one of the plurality of chambers.

4. The fuel rail of claim 1, wherein every outlet is located at the acoustic node of each corresponding chamber to reduce noise generated by the fuel rail.

5. The fuel rail of claim 1, wherein all but one of the plurality of outlets are located at the acoustic node of each corresponding chamber to reduce noise generated by the fuel rail.

6. The fuel rail of claim 5, wherein the one outlet that is not located at an acoustic node is the outlet closest to the inlet.

7. The fuel rail of claim 1, wherein the inlet is located at an acoustic node of a corresponding chamber to reduce hydraulic noise generated by a resonant mode of the fuel passageway.

8. The fuel rail of claim 1, wherein each chamber has a length, and wherein the acoustic node of each chamber is located approximately at a midpoint of the length.

9. The fuel rail of claim 1, wherein the plurality of baffles includes a plurality of inserts, wherein the plurality of inserts is coupled to the elongated tube to divide the fuel passageway into the plurality of chambers, and wherein each insert defines an orifice that allows fluid communication between the plurality of chambers.

10. The fuel rail of claim 9, wherein the elongated tube defines a longitudinal axis, and wherein the orifice of at least one of the plurality of inserts is angled obliquely relative to the longitudinal axis.

11. The fuel rail of claim 9, wherein the orifice of at least one of the plurality of inserts is offset from a center of the at least one of the plurality of inserts.

12. The fuel rail of claim 9, wherein the orifice of at least one of the plurality of inserts is located at a periphery of the at least one of the plurality of inserts.

13. The fuel rail of claim 9, wherein at least one of the plurality of inserts defines a plurality of orifices that allows fluid communication between the plurality of chambers.

14. The fuel rail of claim 1, wherein each baffle is integrally formed as a single piece with the elongated tube.

15. The fuel rail of claim 1, wherein the majority of the plurality of outlets are located at the acoustic node of each corresponding chamber to reduce a resonant frequency greater than 1000 Hz within the fuel rail.

16. The fuel rail of claim 1, further comprising a plurality of fuel injectors, wherein each fuel injector is coupled to one of the plurality of outlets to receive fuel from the fuel passageway at a pressure greater than 20 bar.

17. The fuel rail of claim 1, wherein there is no damper element positioned within the fuel passageway.

18. A method of manufacturing a fuel rail, the fuel rail including an elongated tube having an inlet and a plurality of outlets, the elongated tube defining a fuel passageway for directing fuel toward the plurality of outlets, the method comprising:

providing a plurality of baffles in the elongated tube to divide the fuel passageway into a plurality of chambers, the plurality of baffles restricting fluid flow between adjacent chambers; and immovably positioning the plurality of baffles such that each outlet is positioned in one of the plurality of chambers and a majority of the plurality of outlets are located essentially at an acoustic node of each corresponding chamber to reduce noise generated by the fuel rail.

19. The method of claim 18, wherein immovably positioning the plurality of baffles includes positioning the plurality of baffles such that the majority of the plurality of outlets are located at the acoustic node of each corresponding chamber to reduce hydraulic noise generated by a resonant mode of the fuel passageway.

20. The method of claim 18, wherein immovably positioning the plurality of baffles includes positioning the plurality of baffles such that each outlet is positioned in a separate one of the plurality of chambers.

21. The method of claim 18, wherein immovably positioning the plurality of baffles includes positioning the plurality of baffles such that every outlet is located at the acoustic node of each corresponding chamber to reduce noise generated by the fuel rail.

22. The method of claim 18, wherein immovably positioning the plurality of baffles includes positioning the plurality of baffles so all but one of the plurality of outlets are located at the acoustic node of each corresponding chamber to reduce noise generated by the fuel rail.

23. The method of claim 18, wherein the plurality of baffles includes a plurality of inserts, and wherein providing the plurality of baffles includes inserting the plurality of inserts into the elongated tube to divide the fuel passageway into the plurality of chambers.

24. The method of claim 23, further comprising brazing the plurality of inserts to the elongated tube.

25. The method of claim 18, wherein providing the plurality of baffles includes integrally forming the plurality of baffles as a single piece with the elongated tube.

26. A fuel rail comprising:

an elongated tube including an inlet and a plurality of outlets, the elongated tube defining a fuel passageway for directing fuel toward the plurality of outlets; and a plurality of immovable baffles positioned within the elongated tube to divide the fuel passageway into a plurality of chambers such that each outlet is positioned in one of the plurality of chambers, the plurality of baffles restricting fluid flow between adjacent chambers, wherein every outlet is located at the acoustic node of each corresponding chamber to reduce noise generated by the fuel rail; and wherein each chamber has a length, and wherein the acoustic node of each chamber is located approximately at a midpoint of the length.

* * * * *